US005839181A

United States Patent [19]

Chu

[11] Patent Number: 5,839,181

[45] Date of Patent: Nov. 24, 1998

[54] JIG BENCH FOR FACILITATING ASSEMBLY OF A GOLF CLUB

[76] Inventor: Anna C.H. Chu, 5th Fl.-1, No. 2, Lane 8, Linchuan St., Lingya Dist., Kaohsiung, Taiwan

[21] Appl. No.: 762,774

[22] Filed: Dec. 10, 1996

[51] Int. Cl.[6] ..... B25B 27/14

[52] U.S. Cl. ..... 29/281.5; 29/281.6; 29/283; 29/426.5

[58] Field of Search ..... 29/281.5, 283, 29/281.6, 271, 281.1, 263, 239, 238, 264, 270, 280, 257, 266, 426.5

[56] References Cited

U.S. PATENT DOCUMENTS

| | | | |
|---|---|---|---|
| 3,334,405 | 8/1967 | Cann et al. | 29/257 |
| 4,783,893 | 11/1988 | Farino | 29/426.5 |
| 4,821,391 | 4/1989 | Paterick | 29/263 |
| 4,901,418 | 2/1990 | Machado et al. | 29/263 |
| 5,579,571 | 12/1996 | Park et al. | 29/266 |

*Primary Examiner*—James G. Smith
*Assistant Examiner*—Lee Wilson
*Attorney, Agent, or Firm*—Rosenberg, Klein & Bilker

[57] ABSTRACT

A jig bench for facilitating the assembly of a golf club, consists of a base, a shaft accommodating portion for accommodating a shaft of the golf club and a head accommodating portion for accommodating a head of the golf club. The shaft accommodating portion consists of a first bed pivotably connected to the base, a pneumatically-activated clamp mounted on the first bed for clamping the shaft and a pair of supporting members mounted on the first bed and located beside the clamp for supporting the shaft. The head accommodating portion consists of a second bed pivotably connected to the first bed and a pneumatically-activated clamping mechanism for clamping the head. The jig bench further includes a controlling mechanism which can be manipulated to accurately adjust the relative angle between the first and second beds.

8 Claims, 4 Drawing Sheets

JIG BENCH FOR FACILITATING ASSEMBLY OF A GOLF CLUB

FIELD OF THE INVENTION

The present invention is related to a jig bench, particularly to a jig bench which can help a worker to more conveniently and easily combine the grip, shaft and head of a golf club to obtain the completed golf club.

BACKGROUND OF THE INVENTION

Golf is becoming a more and more popular sport. However, the assembly of the constituting parts of a golf club is not easy. The assembly of a golf club until now has been accomplished by manual force. Prior art has not taught a jig bench which can be manipulated to accommodate the constituting parts of various kinds of golf clubs which have different sizes and configurations to facilitate the assembly thereof; thus, the efficiency of the assembly of golf clubs of prior art is relatively low.

In assembling a head and a shaft of a golf club, it is always required that the trade marks or logos respectively on the two parts should be aligned with each other before the assembly of the golf club is accomplished. Furthermore, since the shaft is relatively slim, it is very difficult to attach a grip to the shaft which has already been assembled with a head without using a jig bench to fixedly clamp the shaft in position.

The present invention therefore is aimed to provide a jig bench for facilitating the assembly of a golf club to mitigate and/or obviate the aforementioned problems.

SUMMARY OF THE INVENTION

An objective of the present invention is to provide a jig bench for facilitating the assembly of a golf club, wherein the jig bench can be manipulated to accommodate the constituting parts of various kinds of golf clubs, whereby a worker can easily use one hand to hold a shaft in position and use the other hand to rotate a head relative to the shaft to make the trade marks or logos respectively on the shaft and the head align with each other before the two parts are fixedly connected with each other.

Another objective of the present invention is to provide a jig bench for facilitating the assembly of a golf club, wherein the jig bench can securely fix a shaft together with a head in position so that a grip can be easily attached to the shaft.

A still further objective of the present invention is to provide a jig bench for facilitating the assembly of a golf club, wherein the jig bench can be easily adjusted to be used for assembling a left-hand or a right-hand golf club.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
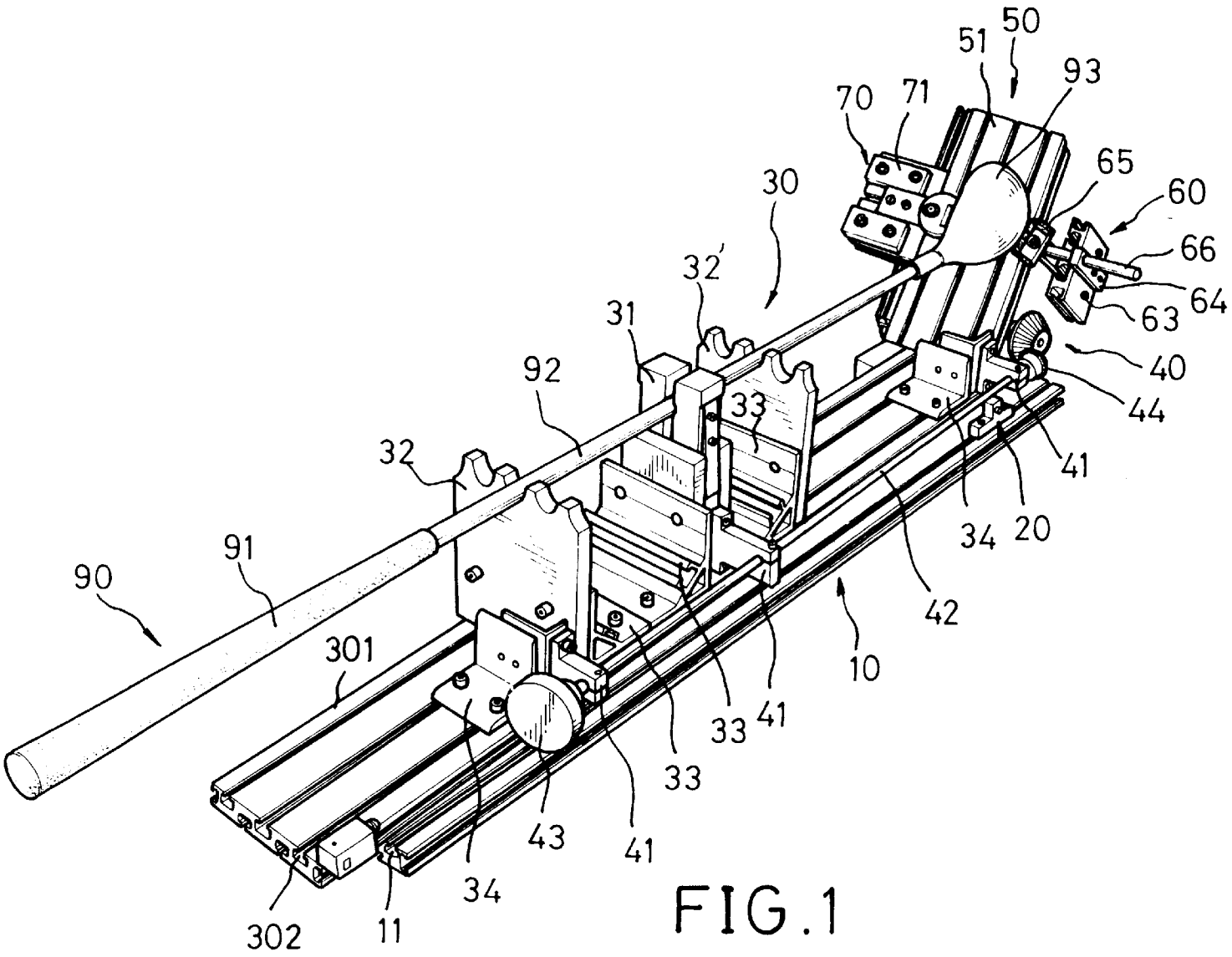
FIG. 1 is a front-left-top perspective view showing a jig bench in accordance with the present invention and a golf club mounted thereon.

FIG. 1 shows a jig bench for facilitating the assembly of a golf club 90 in accordance with the present invention, wherein the golf club 90 consists of a grip 91, a shaft 92 and a head 93. The jig bench consists of a base 10, a shaft accommodating portion 30 pivotably connected to the base 10 via a first pivotably connecting mechanism 20, a head accommodating portion 50 pivotably connected to a first bed 301 of the shaft accommodating portion 30 via a second pivotably connecting mechanism 46 (FIG. 3), whereby the relative angles respectively between the base 10 and the shaft accommodating portion 30 and between the shaft accommodating portion 30 and the head accommodating portion 50 are adjustable.

The base 10 and the first bed 301 of the shaft accommodating portion 30 have a similar configuration. Both the base 10 and the first bed 301 have a plurality of T-shaped slots 11 and 302 on their top faces, respectively.

Figure 2:
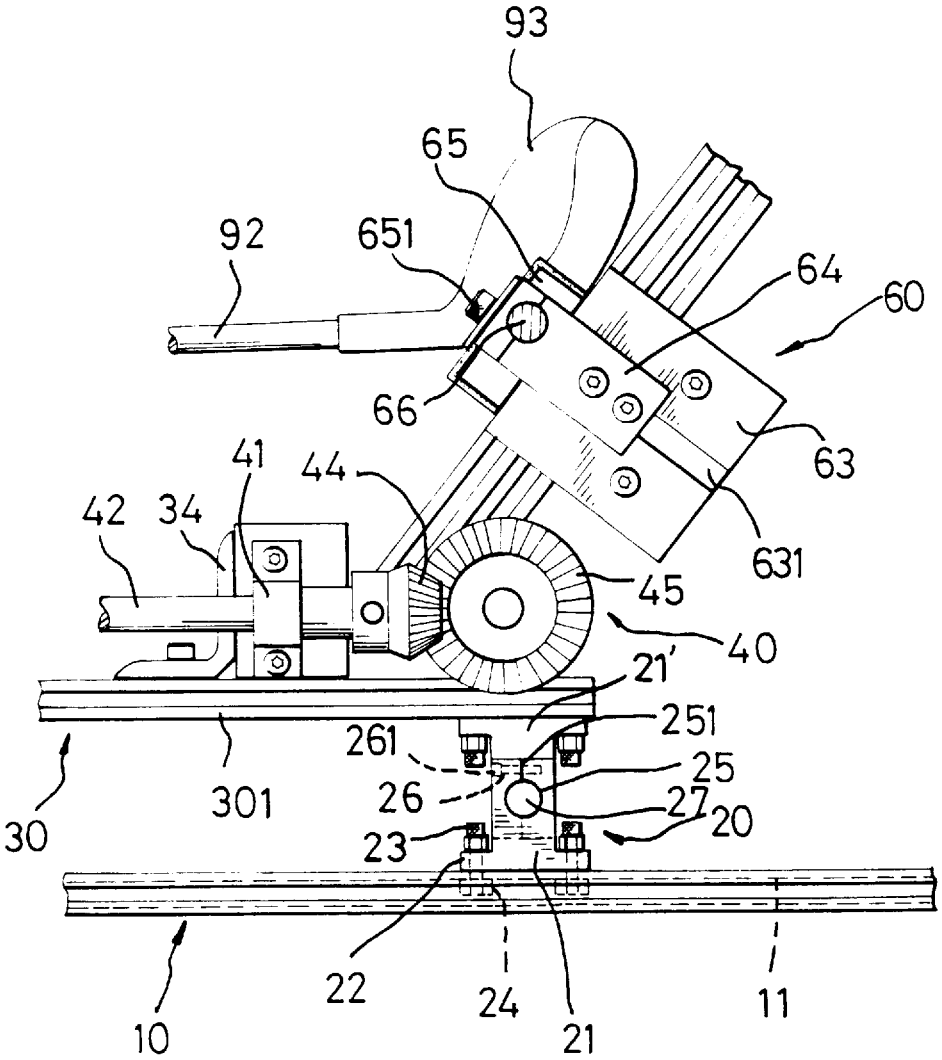
FIG. 2 is a front view showing a right portion of the jig bench and golf club of FIG. 1.
Figure 3:
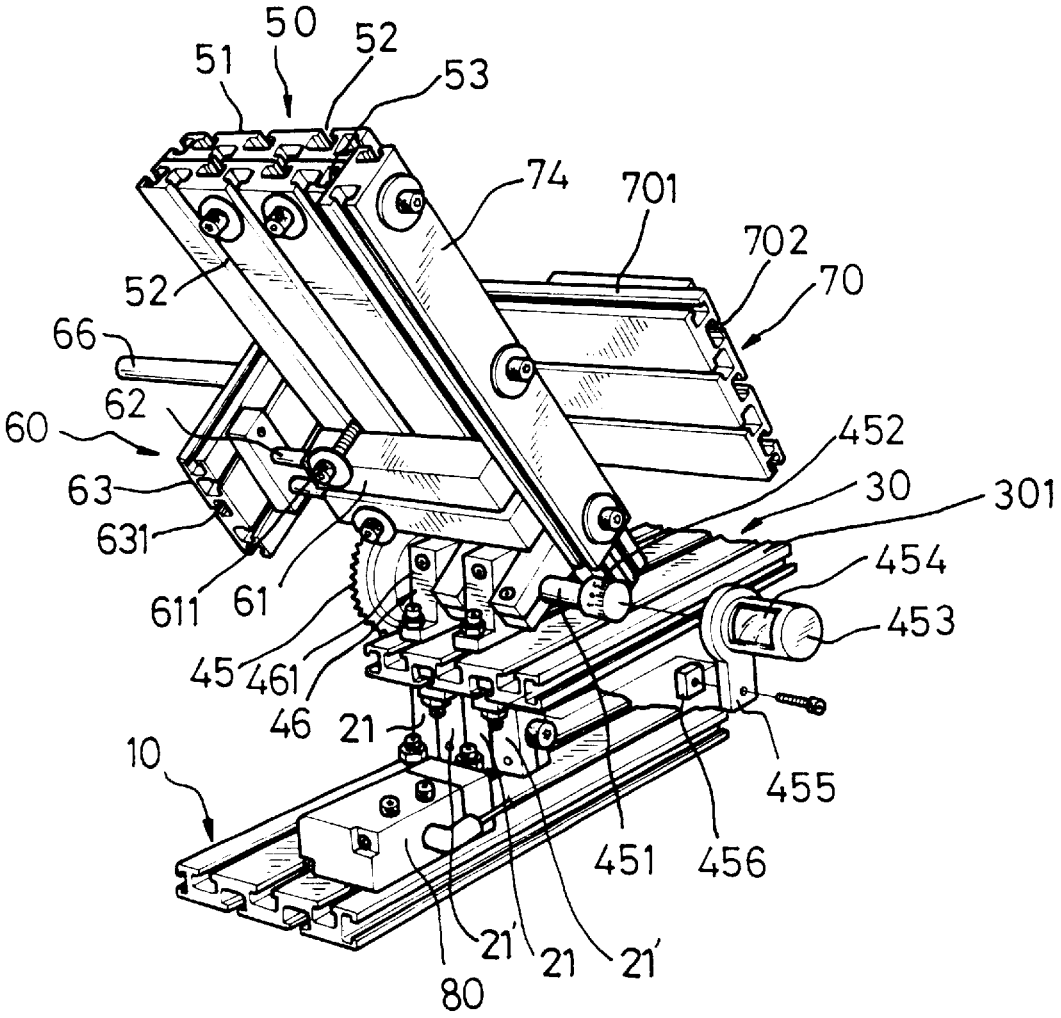
FIG. 3 is a rear-left-top perspective view of the jig bench.

Also referring to FIGS. 2 and 3, the first pivotably connecting mechanism 20 consists of a plurality of T-shaped mounting blocks 21, 21' respectively connected to the base 10 and the first bed 301 and a first axle 27 extending through the mounting blocks 21, 21' and pivotably connected therewith. In this embodiment, two mounting blocks 21 are fixedly connected to the base 10 and the other two mounting blocks 21' are fixedly connected to an underside of the first bed 301. Each one of the T-shaped mounting blocks 21, 21' is configured to have a central portion (not labeled) and two side feet 22. Two bolts 23 each with a large head 24 and two nuts (not labeled) are used to fixedly attach the mounting block 21/21' on the base 10/first bed 301, wherein the large heads 24 of the bolts 23 are received in a respective one of the T-shaped slots 11 and the shanks (not labeled) of the bolts 23 are extended respectively through the two side feet 22 to be threadedly engaged with the two nuts. A slit 251 is defined in a top of the central portion of each of the mounting block 21, 21' and communicates with a hole 25 for receiving the first axle 27, wherein the slit 251 divides the top of the central portion of the mounting block 21 into two parts. A screw hole 26 is defined in the top of the central portion of each of the mounting block 21, 21' and extends through the slit 251 and a screw 261 is used to threadedly engage with the screw hole 26. When the screw 261 is turned to tightly engage with the screw hole 26, the axle 27 is securely connected with the mounting blocks 21, 21'. When the screw 261 is loosened, the mounting blocks 21, 21' can have a pivotable movement relative to the axle 27. When the relative angle between the base 10 and the first bed 301 is to be adjusted, the screws 261 equipped on the mounting blocks 21 connected with the first bed 301 are firstly loosened whereby a worker can pivot the first bed 301 relative to the base to reach a required orientation for the first bed 301, and, then, these screws 261 are re-screwed tightly into the screw hole 26, whereby the first bed 301 can be fixedly held on the required orientation.

Returning to FIG. 1, in addition to the first bed 301, the shaft accommodating portion 30 further comprises a pneumatically-activated clamp 31, first and second shaft supporters 32, 32' provided beside the clamp 31, and three angle irons 33 used to respectively fixedly mount the clamp 31 and the shaft supporters 32, 32' on the first bed 301. Each angle iron 33 includes a horizontal portion and an upright portion. Each of the supporters 32, 32' and the clamp 31 is attached to the upright portion of each the angle irons 33, and the horizontal portion of each of the angle irons 33 is attached to the first bed 301 by extending two screws (not labeled) through the horizontal portion to threadedly engage with two mounting plates (not shown) received in the T-shaped slots 302 of the first bed 301. A plurality of recesses (not labeled) are respectively defined in a top of the shaft supporters 32 and 32' to receive the shaft 92 of the golf club 90, wherein the recesses have different sizes to meet the different diameters of different shafts of different kinds of golf clubs.

The jig bench further includes a controlling mechanism 40 for controlling the relative angle between the head accommodating portion 50 and the shaft accommodating portion 30, wherein the controlling mechanism 40 comprises a force transmitting rod 42 rotatably mounted on three brackets 41 respectively attached to a further angle iron 34 fixedly mounted on the first bed 301 and two sides of the first shaft supporter 32 and the clamp 31. A controlling wheel 43 is fixedly attached to a left end of the force transmitting rod 42 and a first bevel gear 44 is fixedly attached to a right end of the force transmitting rod 42, as shown by FIG. 1, so that when the manipulating wheel 43 is rotated, the first bevel gear 44 rotates accordingly. Also referring to FIG. 3, the second pivotably connecting mechanism 46 for pivotably connecting the head accommodating portion 50 and the shaft accommodating portion 30 together have a structure generally the same as that of the first pivotably connecting mechanism 20. However, the second pivotably connecting mechanism 46 has mounting blocks 461 for connecting with the first bed 301 which are pivotably connected with a second axle 451 extending through the second mounting plates 461 and pivotably connected therewith, while the mounting blocks 461 for connecting with a second bed 51 of the head accommodating portion 50 are securely connected with the second axle 451. A front end of the second axle 451 is fixedly connected with a second bevel gear 45 which in turn is engaged with the first bevel gear 44 whereby when the controlling wheel 43 is rotated, the relative angle between the head accommodating portion 50 and the shaft accommodating portion 30 can be adjusted.

Still referring to FIG. 3, a rear end of the second axle 451 is provided with a first angle indicator 452 which is protected by a cap 453 provided with a transparent window 454, whereby the change of orientation of the head accommodating portion 50 relative to the shaft accommodating portion 30 can be easily read. The cap 453 is fixedly attached to the first bed 301 by extending a screw (not labeled) through a lower extension 455 of the cap 453 to be threadedly engaged with a mounting plate 456 received in a T-shaped slot (not labeled) defined in a rear side of the first bed 301.

The second bed 51 of the head accommodating portion 50 is configured to have a plurality of T-shaped slots 52, 53 respectively defined in its top and bottom faces and front and rear sides. The head accommodating portion 50 further includes a first head clamping mechanism 60 and a second head clamping mechanism 70. The first head clamping mechanism 60 includes a pneumatically-activated cylinder 61 mounted on the bottom face of the second bed 51. The mounting of the cylinder 61 is achieved by means of extending two screws 611 through two washers (not labeled) and into the T-shaped slot 52 to be fixedly engaged with two mounting plates (not shown) received in the T-shaped slots 52, in which the washers are tightly abutted with a bottom face of the cylinder 61. Two pistons 62 are extendibly fitted in the cylinder 61. A distal end of the pistons 62 is fixedly attached to a first mounting member 63, whereby when the cylinder 61 is activated, the first mounting member 63 may have a movement away from or toward the second bed 51. Returning to FIG. 1 and also referring to FIG. 4, a rod 66 for mounting a first clamping member 65 thereon is attached to the mounting member 63 via a mounting block 64 which is attached to the mounting member 63 by extending two screws (not labeled) through the mounting block 64 to be threadedly engaged with two mounting plates (not shown) received in a T-shaped slot 631 (FIG. 3) defined in a front side of the mounting member 63. The first clamping member 65 is made of an elastic material and formed to have a shape like a prismatic rectangular block. Furthermore, the first clamping member 65 is pivotably attached to an end of the rod 66 by a screw 651, whereby the orientation of the first clamping member 65 can be changed to meet the different configurations of the arcuated sides of different heads of different kinds of golf club.

Figure 4:
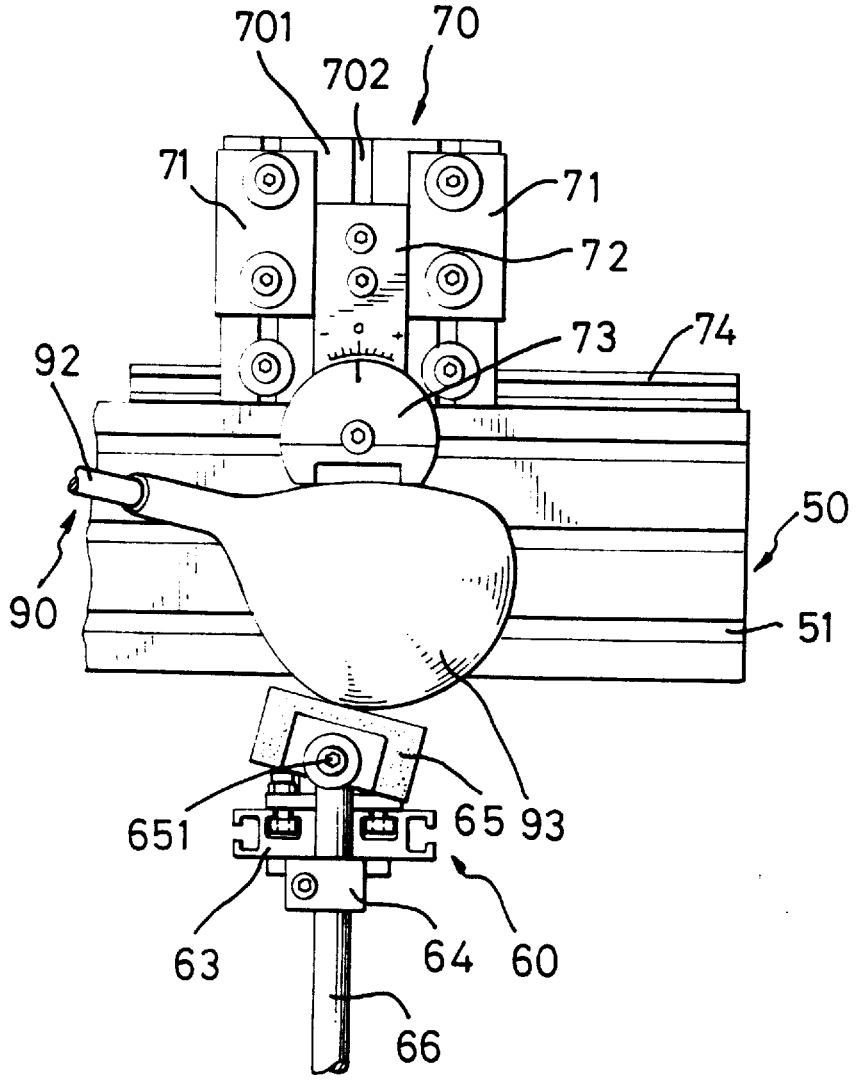
FIG. 4 is a top view showing a head accommodating portion of the jig bench, wherein a head of the golf club is mounted on the head accommodating portion.

Particularly referring to FIGS. 3 and 4, the second head clamping mechanism 70 includes a second mounting member 701 mounted on the second bed 51 via an auxiliary mounting member 74 which is attached to the rear side of the second bed 51 by extending three screws (not labeled) through the auxiliary mounting member 701 to be fixedly engaged with mounting plates (not shown) received in the T-shaped slot 53. A plurality of T-shaped slots 702 are defined in a top face of the second mounting member 701. Two locating blocks 71 are mounted on the top face of the second mounting member 701 and define a channel (not labeled) therebetween. A mounting block 72 is mounted on the top face of the second mounting member 701 and located between the locating blocks 71. A second clamping member 73 is pivotably mounted on an end of the mounting block 72 and faces the first clamping member 65. A second angle indicator (not labeled) is provided on the mounting block 72 near the second clamping member 73 to indicate the orientation of the second clamping member 73. The first and second clamping members 65 and 73 can cooperatively clamp the head 93 in position when the cylinder 61 is activated to cause the first clamping member 65 to move toward the second clamping member 73 through the linking-up of the pistons 62, the first mounting member 63 and the rod 66.

Now returning to FIGS. 1 and 3, a controlling valve 80 is used to control the flow of air from a pressurized air source (not shown) to the pneumatically-activated cylinder 61 and the pneumatically-activated clamp 31, whereby the clamp 31 and the first clamping member 65 can be synchronously activated to perform a clamping action on the shaft 93 and the head 92 of the golf club 90, respectively.

In operation, when the jig bench in accordance with the present invention is used to facilitate the assembly of golf clubs, firstly the shaft accommodating portion 30, the controlling mechanism 40 and the head accommodating portion 50 are manipulated to meet the specific configuration of a batch of the same kind of golf clubs which have the same size and configuration. Then, the worker applies glue to each end of the shafts of the batch of golf clubs which are going to be connected with the heads thereof and connects the shafts and heads together. After the shafts and the heads are connected together and before the glue is cured, a combined shaft and head is put on the jig bench, in which the shaft is supported by the shaft supporters 32, 32' and extended through the clamp 31 and the head is located between the first and second clamping members 65, 73 and rested against the second bed 51, as shown by FIG. 1, in which, however, the clamp 31 and the first and second clamping members 65, 73 are not activated to clamp the shaft and head. Then, the worker can manually to adjust the orientation of the head relative to shaft to make the trade mark or logo on the head align with the trade mark or logo on the shaft. During this operation, the worker can easily hold the shaft in position with one hand and use the other hand to adjust the orientation of the head relative to the shaft.

After the head and shaft are connected together and the trade marks or logos thereon are properly aligned with each other, the clamp 31 and the first clamping member 65 are activated to tightly clamp the shaft and head so that the shaft and head are securely fixed on the jig bench, whereby the grip can be very conveniently attached to the end of the shaft.

After the grip is attached to the shaft connected with the head, the assembly of the golf club is completed. Then, the clamp 31 and first member 65 are activated to release their clamping action on the shaft and head, whereby the golf club can be removed from the jig bench and another combined shaft and head is put on the jig bench to repeat the above operation to complete the assembly of another golf club.

The arrangement of the jig bench as shown by FIG. 1 is used to facilitate the assembly of a right-hand golf club. However, in the present invention, since both the first and second head clamping mechanisms 60, 70 are attached to the second bed 51 by extending screws into T-shaped grooves to threadedly engage with mounting plates in the T-shaped grooves, the worker can easily detach the first and second head clamping mechanisms 60 and 70 from the second bed 51 by loosening these screws and exchange their mounting positions, whereby the jig bench can be used to facilitate the assembly of a left-hand golf club.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A jig bench for facilitating the assembly of a golf club having a head, a shaft and a grip, comprising:

a base;

a shaft accommodating portion, comprising:

a first bed pivotably connected to the base;

a first clamping means mounted on the first bed for clamping the shaft of the golf club; and a supporting means mounted on the first bed for supporting the shaft of the golf club;

a first connecting means for pivotably connecting the base and the first bed together;

a head accommodating portion, comprising:

a second bed pivotably connected to the first bed; and a second clamping means mounted on the second bed for clamping the head of the golf club;

a second connecting means for pivotably connecting the first bed and the second bed together; and a controlling means for controlling a relative angle between the first bed and the second bed.

2. The jig bench in accordance with claim 1, wherein the base, first and second beds each have a top face, a bottom face, a front side and a rear side, said top, bottom faces and front and rear sides being so configured that a plurality of T-shaped slots are defined therein.

3. The jig bench in accordance with claim 2, wherein the first clamping means is a pneumatically-activated clamp and the supporting means is a pair of supporting members located beside the clamp, each said supporting members defining a plurality of recesses on a top thereof for receiving the shaft of the golf club.

4. The jig bench in accordance with claim 3, wherein each of the supporting members and clamp is mounted to the first bed by an angle iron which has an upright portion connected with one of the supporting members and clamp and a horizontal portion connected to the first bed by extending screws through the horizontal portion to threadedly engage with mounting plates received in the T-slots defined on the top face thereof.

5. The jig bench in accordance with claim 2, wherein the first connecting means comprises a plurality of T-shaped mounting blocks respectively and fixedly attached to the base and the first bed, a first axle extending through the T-shaped mounting blocks and pivotally connected therewith, each of said T-shaped mounting blocks defining a central portion and two side feet which are respectively and fixedly attached to the base and the first bed by extending two bolts through the side feet to fixedly engage with two nuts, respectively, wherein each of said bolts has a larger head received in a respective one of the T-shaped slots formed on the base and the first bed, said central portion having a slot dividing a top of the central portion into two parts and communicating with a hole for receiving the first axle and a screw hole extending through the slit, a screw threadedly engaging with the screw hole.

6. The jib bench in accordance with claim 2, wherein the second connecting means comprises a plurality of T-shaped mounting blocks respectively and fixedly attached to the first and second beds, a second axle extending through the T-shaped mounting blocks and pivotally connected therewith, each of said T-shaped mounting blocks defining a central portion and two side feet which are respectively and fixedly attached to the first and second beds by extending two bolts through the side feet to fixedly engage with two nuts, respectively, wherein each of said bolts has a larger head received in a respective one of the T-shaped slots formed on the first and second beds, said central portion having a slit dividing a top of the central portion into two parts and communicating with a hole for receiving the first axle and a screw hole extending through the slit, a screw threadedly engaging with the screw hole, said second axle having a first end attached with an angle indicator and a second end.

7. The jig bench in accordance with claim 6, wherein the controlling means comprises a force transmitting rod rotatably mounted on the jig bench and defining a third end and a fourth end, a controlling wheel fixedly attached to the third end, a first bevel gear fixedly attached to the fourth end, and a second bevel gear fixedly attached to the second end of the second axle and engaging with the first bevel gear.

8. The jig bench in accordance with claim 1, wherein the second clamping means comprises:

a pneumatic cylinder attached to the second bed and equipped with at least one piston extensible from the cylinder;

a first mounting member attached to the at least one piston;

a rod attached to the first mounting member;

a first clamping member pivotably attached to the rod, in which when the pneumatic cylinder is activated the first clamping member can move toward or away from the second bed;

a second mounting member attached to the second bed;

a pair of locating blocks mounted on the second mounting member and defining a channel therebetween;

a mounting block mounted on the second mounting member and located between the two locating blocks; and a second clamping member attached to an end of the mounting block and facing the first clamping member, in which when the first clamping member is moved toward the second bed, said first and second clamping members can cooperatively clamp the head of the golf club.

* * * * *